United States Patent [19]

Marchesi

[11] Patent Number: 4,685,406

[45] Date of Patent: Aug. 11, 1987

[54] LOOPER FOR SEWING MACHINES

[75] Inventor: Franco Marchesi, Pavia, Italy

[73] Assignee: Rockwell-Rimoldi S.p.A., Italy

[21] Appl. No.: 728,370

[22] Filed: Apr. 29, 1985

Related U.S. Application Data

[63] Continuation of Ser. No. 537,766, Sep. 30, 1983, abandoned.

[30] Foreign Application Priority Data

May 6, 1983 [IT] Italy ..... 20970 A/83

[51] Int. Cl.[4] ..... D05B 57/02

[52] U.S. Cl. ..... 112/199; 112/226; 112/270

[58] Field of Search ..... 112/270, 165, 166, 199, 112/200, 226

[56] References Cited

U.S. PATENT DOCUMENTS

| | | | |
|---|---|---|---|
| 152,798 | 7/1874 | Hall | 112/226 X |
| 591,545 | 10/1897 | Onderdonk | 112/165 |
| 597,610 | 1/1898 | Hart | 112/270 |
| 1,257,464 | 2/1918 | DeVoe | 112/200 |
| 1,950,336 | 3/1934 | Zeier | 112/200 X |
| 2,260,384 | 10/1941 | Kibitz et al. | 112/200 |

FOREIGN PATENT DOCUMENTS

| | | | |
|---|---|---|---|
| 548190 | 10/1957 | Canada | 112/226 |

*Primary Examiner*—Wm. Carter Reynolds

[57] ABSTRACT

Looper for sewing machines provided with a mounting shank having a positioning flat adapted to be coupled to a coacting flat formed on a positioner member, which positioner member can be angularly fastened on a looper support so that the coupling between the looper and the positioner takes place in a predetermined angular position in one and the same hole of the looper support.

5 Claims, 3 Drawing Figures

LOOPER FOR SEWING MACHINES

This application is a continuation of application Ser. No. 537,766, filed Sept. 30, 1983, now abandoned.

BACKGROUND OF THE INVENTION

In sewing machines equipped with one or more loopers, that is to say, chain stitch or overcase stitch machines or for so-called safety sewing machines provided with one chain stitch looper and two overcast stitch loopers, the problem arises of correct synchronization of the loopers with one another and with the corresponding needles, that is to say, the correct formation of the stitching.

Correct positioning of the loopers in respect of height is achieved in known manner with the aid of a plate which is fastened to the looper support in an adjustable manner, so that the looper is secured in the correct position. Consequently, loopers which are replaced in the course of time are always positioned against this plate in such a manner that adjustment in respect of height relative to the needles and the other loopers is achieved without the synchronization operation having to be repeated.

The same is not true of the angular position of the loopers, which in known manner is adjusted every time a looper is replaced.

The technical problem underlying the present invention is precisely that of obviating this disadvantage, in such a manner than when the loopers are replaced, they are correctly positioned without it being necessary to repeat every time the operation of angular adjustment.

This technical problem has been solved with a looper provided with a shank adapted to be fastened to its support, with the characteristic that the said looper is equipped with positioning means adapted to be coupled in a single predetermined position, onto corresponding means formed on a positioner which is mounted in the same hole of the looper support into which said looper is introduced too; distinct fastening means are provided for fixing to the support, respectively, the angularly orientable positioner and, above the latter, the shank of the looper.

More precisely, the said coupling means consists of a flat provided on the looper shank and of a similar coacting reference flat provided on the positioner.

Furthermore, the positioner, which is adapted to be inserted into a hole in the said support and is angularly orientable therein, is a cylindrical member on which the coacting flat is formed parallel to the axis of this cylindrical mamber, while similarly, the coupling flat formed on the shank of the looper is parallel to the axis of the said shank.

Finally, the aforesaid fastening means consist of two screws, of which one fastens the looper shank to the support while the other is positioned below the first screw so as to fasten only the positioner.

With such characteristics, the advantage is gained that the angular adjustment of a looper relative to the corresponding needle or to the other loopers is effected the first time and afterwards is no longer required for the other replacement loopers fitted in the course of time.

SUMMARY OF THE INVENTION

Thus, the principal object of this invention is to provide a looper mounting system whereby positioning of a looper need be performed only on initial setup.

BRIEF DESCRIPTION OF THE DRAWINGS

Other objects and advantages of this invention will be in part obvious and in part explained by reference to the accompanying specification and drawings, in which:

Referring to FIG. 1, the upper looper 1 for overcast stitching describes the trajectory A, while the lower looper 2 describes the trajectory B, and, together with the needle 3 which describes the rectilinear trajectory C, these loopers form the known overcast stitch. Thus, the chain stitch looper 4 describes the elliptical trajectory D and together with the needle 5, which describes the rectilinear trajectory E, forms the known chain stitch. The two needles 3 and 5 are fixed in known manner to a suitable clamp holder 6. The two simultaneously made seams, that is to say, the overcast stitching on the edge of the fabric (not visible in the drawing) and the chain stitching parallel to the edge, form the so-called safety stitching in the direction of the feed line F.

For the perfect formation of the stitches, either in machines producing safety stitching or in simpler machines in which there is only one needle in combination with a single looper, it is obviously necessary to have correct adjustment between needle and looper, both in respect of height and angularly.

Figure 1:
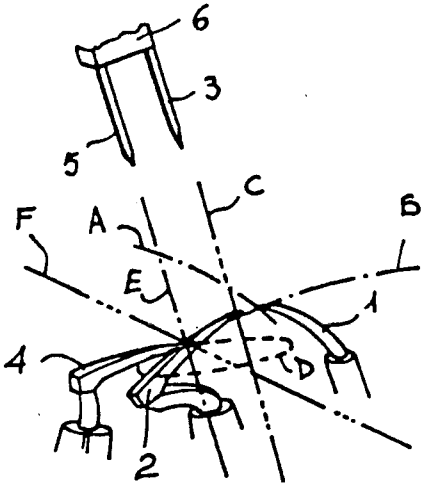
FIG. 1 shows in prespective the reciprocal positions of the loopers relative to the needles in safety sewing machines.
Figure 2:
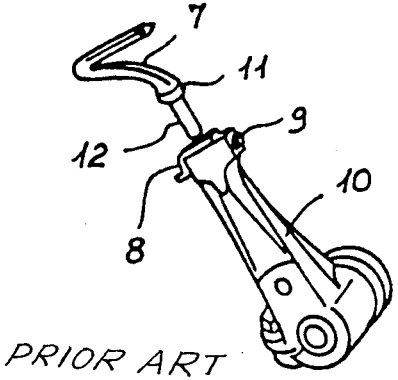
PRIOR ART Fig-2
FIG. 2 shows in perspective a prior art known coupling between the looper shank and the support.

According to the known technique, illustrated in FIG. 2, adjustment in respect of height of a generic looper 7, of the same type as those described above, is effected with the aid of appropriate gauges and by means of the plate 8, which can be adjustably positioned at various heights by known means (now shown).

The screw 9 fastens the looper 7 to the support 10 in such a manner that the widened part 11 of the shank 12, when the latter is inserted into the hole in the support 10, bears against the plate in a predetermined position. When the looper is replaced, adjustment in respect of height is maintained, since the part 11 always bears against the plate 8 in the correct position adjusted once and for all. The angular adjustment of the tip of the looper 7 is also achieved with the aid of gauges; but every time the looper is replaced, the adjustment operation must be repeated. The shank 12 is in fact inserted into the hole in the support 10, positioned correctly relative to the needle or the other loopers, and fixed in that position by means of the screw 9, but there is no reference permitting a new looper to assume the correct angular position.

Figure 3:
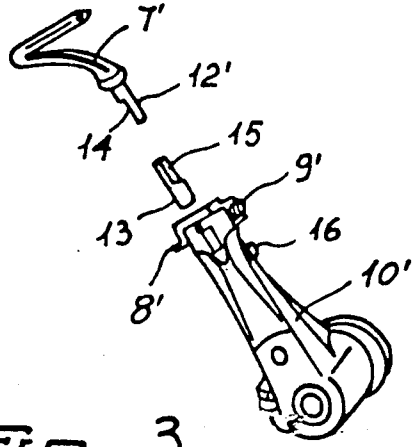
FIG. 3 shows in perspective the new coupling between the shank, the positioner and the looper support forming the object of the present invention.

This is not the case in the arrangement illustrated in FIG. 3 in accordance with the present invention, wherein the looper 7' is provided with positioning means formed laterally on its shank 12' which is adapted to be coupled to similar means belonging to a cylindrical positioner member 13 disposed coaxially to the shank 12'. Said positioner is adapted to be inserted into the same hole in the support 10' in which it is usually mounted the looper of the sewing machine. More particularly, said positioning means formed laterally on the shank 12' consists of a flat 14 which is adapted to be coupled to a similar coacting reference flat 15 provided on the positioner 13. Positioner 13 has a coacting flat 15 parallel to its axis in the same manner as the flat 14 is parallel to the axis of the shank 12'. Shank 12', in turn, coincides with the axis of said positioner 13.

Independent fastening means consisting of a screw 16, fastens the positioner 13 to the support 10' itself, and likewise, the screw 9' independently fastens the shank 12' to the support 10', the flat 14 exactly mating with the coacting flat 15. Therefore the mounting operations take place as follows: first the positioner member 13 is introduced into the hole in the support 10' and subsequently also the shank 12' of the looper 7' is introduced into said hole taking care that the two positioning flats 14 and 15 can correctly mate with each other.

Still afterwards, the preliminary synchronization operations of the stitching members in the sewing machine are carried out and therefore the synchronization operations of the looper 7' together with the positioner 13. These preliminary operations involve the angular adjustment of the looper 7' and of the positioner 13 relative to the needle and consequently the fastening of the same in this position, each one by means of its own screw 9' and 16, at the end of the above operations.

Once the positioner 13 is fastened in its exact angular position, the looper can be removed by simply slackening the screw 9' and mounted again or replaced by introducing the shank into the hole in the support 10' as far as the flat 14 fits against the coacting flat 15 on the positioner 13 in a single predetermined position which is the only possible position after the synchronization operations.

With this arrangement, the advantage is gained that the angular adjustment is maintained without it being necessary to repeat it whenever the looper is replaced.

Modifications and variations can be made without thereby departing from the scope of the present invention.

I claim:

1. An improved looper mounting for use in sewing machines having a looper support arm with a hole in the outer end thereof, said improved looper mounting comprising:

(a) angularly orientable positioner receivable into the hole in the looper support arm;

(b) position indexing means on said positioner;

(c) a looper having a shank portion;

(d) indexing means on the shank of said looper and shaped to cooperate with said indexing means on said positioner; and (e) fastening means extending through said looper support for fastening to said support, respectively, said positioner and above the latter said looper shank, in such a manner that the coupling between the shank and the positioner is effected in a single predetermined position.

2. The improved looper mounting as defined in claim 1 wherein said position indexing means on said positioner and on said looper shank comprise mating planar surfaces extending parallel to the axes of said positioner and of said looper shank.

3. In a sewing machine utilizing a looper for stitch formation, the combination comprising:

(a) a looper support arm attached to a drive shaft for rocking to and fro, said looper support having a hole in the end thereof;

(b) an angularly orientable positioner having indexing means thereon situated within the hole in said looper support;

(c) a looper having a shank portion and indexing means thereon to cooperate with said positioner indexing means and thereby angularly orient said looper in its selected position; and (d) a first fastening means extending through said looper support arm, for fastening said positioner to said support arm, and separate fastening means above said first fastening means to fasten said looper shank/against said positioner in such manner that the coupling between the shank and the positioner is effected in a single predetermined position.

4. The combination as set forth in claim 3 wherein said fastening means comprises threaded fasteners.

5. The combination as set forth in claim 4 wherein said indexing means comprises mating planar surfaces extending parallel to the axes of said looper shank and said positioner.

* * * * *